United States Patent [19]

Vetter

[11] Patent Number: 4,784,507

[45] Date of Patent: Nov. 15, 1988

[54] FILING DEVICE FOR LAYERS OF SHEETS

[75] Inventor: Hans Vetter, Stuttgart, Fed. Rep. of Germany

[73] Assignee: Merz und Vetter GmbH, Fed. Rep. of Germany

[21] Appl. No.: 896,447

[22] Filed: Aug. 13, 1986

[30] Foreign Application Priority Data

Aug. 28, 1985 [DE] Fed. Rep. of Germany ..... 3530632

[51] Int. Cl.[4] ..... B42F 3/00; B42F 13/10

[52] U.S. Cl. ..... 402/13; 281/15 R; 402/19; 402/22; 402/68; 402/80 P

[58] Field of Search ..... 281/15 R, 15 A, 19 R, 281/21 R, 21 A, 22, 28; 402/8, 13, 14, 15, 19, 21, 22, 23, 60, 61, 64, 68, 80 P

[56] References Cited

U.S. PATENT DOCUMENTS

| | | | |
|---|---|---|---|
| 2,773,504 | 12/1956 | McGrervey | 402/8 |
| 3,834,824 | 9/1974 | Jahn | 402/13 |
| 4,174,909 | 11/1979 | Jahn | 402/13 |
| 4,192,620 | 3/1980 | Jahn | 402/15 |
| 4,256,411 | 3/1981 | Podoser | 402/19 |
| 4,261,664 | 4/1981 | Crawford | 402/13 |

FOREIGN PATENT DOCUMENTS

| | | | |
|---|---|---|---|
| 2612625 | 9/1977 | Fed. Rep. of Germany | 402/8 |
| 2724618 | 12/1978 | Fed. Rep. of Germany . | |
| 2947609 | 5/1981 | Fed. Rep. of Germany . | |
| 59846 | 6/1960 | India | 402/13 |
| 516411 | 1/1982 | Switzerland . | |

*Primary Examiner*—Paul A. Bell

*Attorney, Agent, or Firm*—Steele, Gould & Fried

[57] ABSTRACT

A filing device produced as a continuous one-piece body from a sheet or foil by a punching - stamping process has sequencing tongues supported as bending-elastic compression members moving easily with the folding movements of the file covers in insert strips and which are provided with locking members for easily detachable locking in their fastening position. This avoids bending of the sequencing tongues when closing the file covers and the sheets of the fastened sheet layers can be easily turned over and back along the sequencing tongues without the latter accidentally sliding out of the insert strips.

32 Claims, 7 Drawing Sheets

FILING DEVICE FOR LAYERS OF SHEETS

BACKGROUND OF THE INVENTION

The invention relates to a filing device for layers of sheets provided with holes. A one-part folded body is separated from a flat, flexible blank having a substantially constant thickness, such as a plastic film, sheet or the like and forms two fastening sides movable through a folding joint zone between an opened out and accessible position and a folded, closed position with the insides thereof against one another. One of said sides as a threading or sequencing side has at least two threading or sequencing tongues for receiving layers of sheets via holes and whereof the other as a counter-side for each sequencing or threading tongue is provided with an insert opening for each tongue in a raisable insert strip and into which the associated sequencing tongue can be inserted from its sequencing position into its filed position.

A filing device of this type is known (Offenlegungsschrift 26 12 625, dated Sept. 29, 1987), which is formed by a one-part punched piece in such a way that the fastening sides, sequencing tongues and insert strips are made from one piece. In this filing device, as is generally the case with such devices, it has not proved possible to achieve such a good function as in the case of multipart filing devices, particularly those in which the sequencing tongues are formed by separate, subsequently fixed components. The behaviour of the sequencing tongues during the opening and closing of the filing device could hitherto only be influenced by the choice of material and the cross-sections of the tongues, namely in that the tongues are made in a relatively hard resilient manner from a different material than the fastening sides. In the case of the known one-part device, the sequencing tongues are made from the same flexible material, i.e. less bending-elastic than bending-soft or slack material, so that there is a risk in the case of said tongues that they will become folded over themselves in the fastening position during the closing of the filing device and can consequently become permanetly bent. This can also not be prevented in that the sequencing tongues in conjunction with the insert strips are constructed in such a way that the tongues are pulled instead of pushed through the insert openings of the insert strips, i.e. engaged in the openings in the strips with a much higher frictional resistance than their bending strength although said frictional resistance is smaller than their tensile strength. If bending of the sequencing tongues is to be avoided on closing the filing device, it is necessary to pull manually inside of the counter-side, on the ends of the sequencing tongues projecting through the insert strips until the filing device is folded shut, so that the strips are displaced in accordance with the shortening of the distance between said strips and the tongue heels. However, as this is very cumbersome and as even a single handling error can lead to permanent deformation of at least one sequencing tongue, said filing device has not been adopted, although there is a very pronounced need for a one-part, but correctly functioning filing device due to the particular advantages resulting from the fact it cannot be destroyed, has a low weight, a limited spatial extension and is esthetically pleasing.

These advantages also fail to appear in known multipart filing devices (U.S. Pat. No. 2,773,504). They are also much more complicated to manufacture, rivets or clips being required for fixing individual folding layers to one another. In particular separate sequencing tongues are required whose material characteristics are adapted to requirements. Although these sequencing tongues will bend, they are resistant to bending, i.e., they have a certain stability with respect to their bending resistance in the particular bending state. This is intended to achieve that on folding together or closing the fastening sides, the sequencing tongues automatically slide into the insert openings under the stresses which occur and consequently adapt their position to the position of the insert strip. However, it has been found that the use of a flexible sequencing tongue with a certain stability in the bent shape still cannot prevent there being such a large jamming force between between counter-side and sequencing tongue when closing the fastening sides that the sequencing tongue folds over on itself instead of sliding and therefore becomes unusable due to the formation of a bend point or kink.

SUMMARY OF THE INVENTION

The problem of the present invention is to provide a filing device of the aforementioned type, which on the one hand has the advantages of production from a one-part opening out blank and on the other hand ensures that the sequencing tongues cannot be damaged during the correct use of the filing device.

According to the invention this problem is solved in the case of a filing device of the aforementioned type in that the insert opening is wider compared with the cross-section of at least one portion of the sequencing tongue constructed in one piece with the insert strip engaging therein with clearance of motion in the fastening position for forming a sliding opening to such an extent that said portion in any position of the fastening sides is mounted in easy longitudinally displaceable manner in the insert strip, and the sequencing tongue is supported with respect to the sequencing side as a bending-elastic compression member with respect to the sliding resistances which occur. Thus, despite the one-part construction and unlike in the known solutions, by a suitable supporting and construction of the sequencing tongue, a bending-elastic compression member which springs back from any bending deformation is obtained, whose compression loadability both in itself and in the support with respect to the sequencing side is so matched to the bearing or mounting in the vicinity of the sliding opening or counter-side, that there is no need to fear bending on closing the filing device as a result of the sliding resistances which occur and which are applied to the sequencing tongue as compressive forces.

For supporting the sequencing tongue with respect to the sequencing side in such a way that the tongue in the vicinity of its articulated connection to the sequencing side does not give way through articulation movements even if only a very small number of sheet layers is filed, can in particular be achieved in that the spring-elastic sequencing tongue connects with the sequencing side by means of a tongue joint constructed in one piece therewith and with the sequencing side with a single tongue joint axis substantially parallel to the central axis of the folding joint zone and at least approximately in the plane of the inside of the sequencing side, which is stable both with respect to the sequencing tongue and with respect to the sequencing side. As opposed to this a tongue joint formed by a portion of a tongue heel rounded in pitch circular manner has no precisely defined tongue joint axis, because a more or less large length portion of the tongue heel participates in the joint curvature.

In the case of shear stressing, a rounded tongue joint very rapidly is subject to rolling yielding and therefore to bending of the sequencing tongue. Even a tongue heel bent to the bearing sleeve and whose internal diameter is larger than the engaging bearing member has no tongue joint axis, whose position is precisely defined with respect to the associated end of the sequencing tongue, because as a result of its radial clearance the bearing sleeve can engage on the bearing member with different portions along its inner circumference and only then determines the tongue joint axis. In the invention it can be adequate if the tongue joint is not provided from the outset and is merely e.g. such that through a single folding or bending of the sequencing tongue in the vicinity of its connection to the inside of the sequencing side, as a result of the material changes in the bend cross-section of the sequencing tongue which occur, the joint can be formed prior to the initial use of the filing device. The tongue joint can also be marked from the outset, e.g. by a desired bending point with a reduced bending strength compared with the remaining portions of the sequencing tongue.

The support of the sequencing tongue secured against undesired joint movements in the tongue joint can also be improved by restricting motion of the tongue joint in a manner matched to the requirements. The joint is appropriately constructed so resiliently that within an acute swivel angle it returns the sequencing tongue at least in one swivelling direction to an initial position. The tongue joint can be constructed in such a way that if the sequencing tongue is swivelled over and beyond said swivel angle, it is only swivelled back over the predetermined restoring angle, i.e it then assumes a displaced starting position. The tongue joint is appropriately constructed in such away that this adjustment of the starting position can take place in repeated manner, without any significant decrease in the resilient characteristics of the tongue joint.

According to a particularly advantageous further development of the invention, the free end of the sequencing tongue adjacent to an end portion slidingly guided on the inside of the counter-side in the fastened position has a locking member which is easily detachable but prevents unresisted or accidental removal of the sequencing tongue from the insert strip. The end portion can be unlocked by a simple transverse movement of the associated portion of said tongue. The locking member is constructed in such a way that in the locked position it only resists movements through or from the insert strip, whereas in the opposite direction, i.e. in the movement direction of the sequencing tongue associated with the closing of the fastening sides, it in no way impairs ease of displacement thereof, even directly from the locking position. Thus, from the locking position, the locking member can be raised again from its associated counter-member without any increased resistance.

The unlocking of the sequencing tongues in the known filing devices is relatively difficult, because the locking members have a tendency to jam or hook in the vicinity of the insert openings and can generally only be guided through the insert opening using two hands. As a result of the inventive construction, it is possible in a particularly advantageous manner to so construct the locking members of the sequencing tongues that both tongues can be simultaneously unlocked very rapidly and with only one hand. For this purpose use is made of a resiliently curved sequencing tongue portion, particularly the displacement portion located between the sliding opening and the sequencing portion intended for engagement in the hole system in the fastening and access position and, as a funtion of the construction of locking members, is either merely depressed or twisted by pressure against its lateral edge in order to bring the locking member into a position relative to the insert strip in which it is no longer effective.

To keep the sliding resistances acting on the sequencing tongue as low as possible, for each sequencing tongue is provided a separate and preferably bow-shaped insert strip, so that the sliding opening is not completely defined solely by said strip, but extends relatively far up to the inner face of the counter-side and from there is bounded by the associated side facing the bow yoke. This is helped by the fact that the insert strip has to be swung from its opened out position free of the counter side away from the folding joint zone into its raised position, because as a result of the one-part construction with the counter-side higher resilience forces act thereon counter to said swivel or swinging direction than in that direction. As described in connection with the sequencing tongue, the insert strip is preferably constructed in such a way that it is resilient due to the characteristics of its strip joint. The easy motion of the sequencing tongue in the sliding opening is also defined by the position of the insert strip with respect to the center of the width of the folding joint zone.

Appropriately the distance of the strip joint axis from said center is at the most only slightly smaller and preferably at least as large as the corresponding distance of the tongue joint axis from said center of the folding joint zone. The strip joint can be constructed and positioned as described in connection with the tongue joint.

On inserting the sequencing tongues into the insert strips, in the case of a one-part-punched filing device, there is a risk of the sequencing tongue being inserted through the cutout in the counter-side formed by the separation of the insert strip in the counter-side and which is open in this region with the strip raised. Thus, instead of being inserted into the insert opening, the sequencing tongue is accidentally passed through the cutout on the outside of the counter-side, which makes it more difficult to thread the sequencing tongue into the insert opening. With the inventive construction, this risk can be considerably reduced in that through the bow shape of the insert strip a guide tongue remaining in the plane of the rest of the counter-side is obtained and its width is appropriately larger than the width of the bow leg or the associated leg portions of the strip cutout and which extends close to the transverse boundary thereof, so that the free tongue end is placed against said guide tongue during the threading of the sequencing tongue and can then be inserted through the sliding opening whilst being supported in a guided manner.

In order that there is no need to deform the sequencing tongues for forming the locking member and said tongue can instead be simply produced by a punching cut, the locking member is essentially formed by a widened end portion of the sequencing tongue, which has locking shoulders projecting over one lateral edge of the sequencing tongue and in the vicinity thereof forms the zone of greatest width of the sequencing tongue, whose width is appropriately adapted to the width or diameter of the associated hole system, so that it can just be inserted into said hole system with a limited clearance of motion. The portion of the sequencing tongue connecting onto the locking shoulder towards the tongue route has a width so adapted to the sliding opening width that it fits between the lateral boundary edges of the sliding opening with a limited lateral clearance of motion of tenths of a millimeter. For the easier insertion of the sequencing tongue both in the hole system and in the sliding opening one lateral edge, namely that connected to the locking member, slopes to the free tongue end, said sloping lateral edge passing into the locking shoulder at an obtuse angle.

A particularly advantageous further development, especially of a filing device of the aforementioned type comprises a sequencing tongue which is narrower than the width of the holes of the hole system, and is so displaced with regard to its median longitudinal plane with respect to the hole system pattern, that it engages with one lateral edge on the inner boundaries of the hole system, whereas with its other lateral edge it is spaced from the inner face of the hole system. If two sequencing tongues are oppositely displaced in this way, they very accurately reciprocally align the layers of sheets through said engagement on the inner faces of the hole system, so that the stresses acting from the layers of sheets on the sequencing tongues are very uniformly distributed and remain low. If the aligning edges are the lateral edges of the sequencing tongues remote from the locking members, then the sequencing tongues can perform the unlocking movements without any difficulty and readily release the hole system during unfastening.

The accuracy of manufacture can also have a considerable influence on the reliable function of the filing device. When the complete filing device is produced and completed by a single punching process, e.g. by means of a belt knife, this can in particular lead to imprecisions and manufacturing errors, so that cut particles of the plastic foil, sheet or the like formed during the punching can remain in the vicinity of the cutting die and are in the way of following cutting or punching operations. Thus, according to the invention, both the sequencing tongues and the insert strips are separated from the remaining associated fastening side by cutting particle-free cuts, so that a cutout congruent with the shape of the sequencing tongue or insert strip is formed and no cut particles occur. It is also advantageous for this production procedure, if all the joint slots are produced by stamping processes from the same side of the blank and this is appropriately the same side from which the cutting die is moved against the blank during cutting or punching, so that a single tool can simultaneously produce both the separating cuts and the joint slot stampings.

At least one fastening side of the filing device according to the invention can be e.g. smaller all around a pierpheral strip than the sheet layers to be filed. For producing a filing device in the form of a file, whereof at least one fastener cover completely covers the filed sheet layers, the particular fastener or file cover forms the associated fastening side in one piece with the remaining filing device. It has proved particularly advantageous for obtaining the described effects if the filing device is made from a polypropylene sheet, but it is also conceivable to use sheets with zones of different material characteristics or different materials at right angles to the folding joint zone and these are produced as one-piece composite sheets. In e.g. grid-like manner, the sheet can have zones of different thickness, by providing same with stamping-like profilings, particularly on the outside.

The filing device according to the invention is suitable for all types of hole systems, i.e. with two, three, four and more holes, the eccentrically arranged sequencing tongues for raising the sheet layers being appropriately formed by the outermost tongues. In the case of more than two sequencing tongues, only two sequencing tongues which are preferably located symmetrically on either side of a hole system median plane have locking members or all the sequencing tongues can be provided with such locking members. In the case of an uneven number of sequencing tongues, appropriately the locking members are provided in pairs on said tongues.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 23:
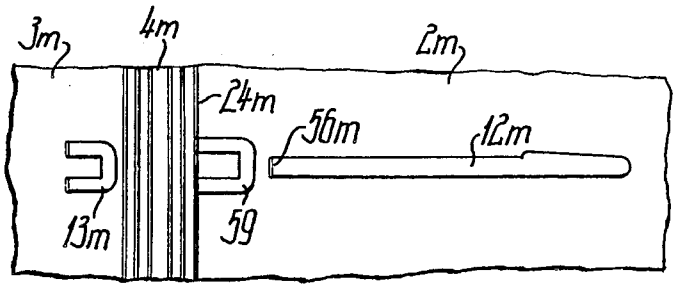
FIG. 23, another embodiment of a filing device in a representation corresponding to the detail of FIG. 2.
Figure 1:
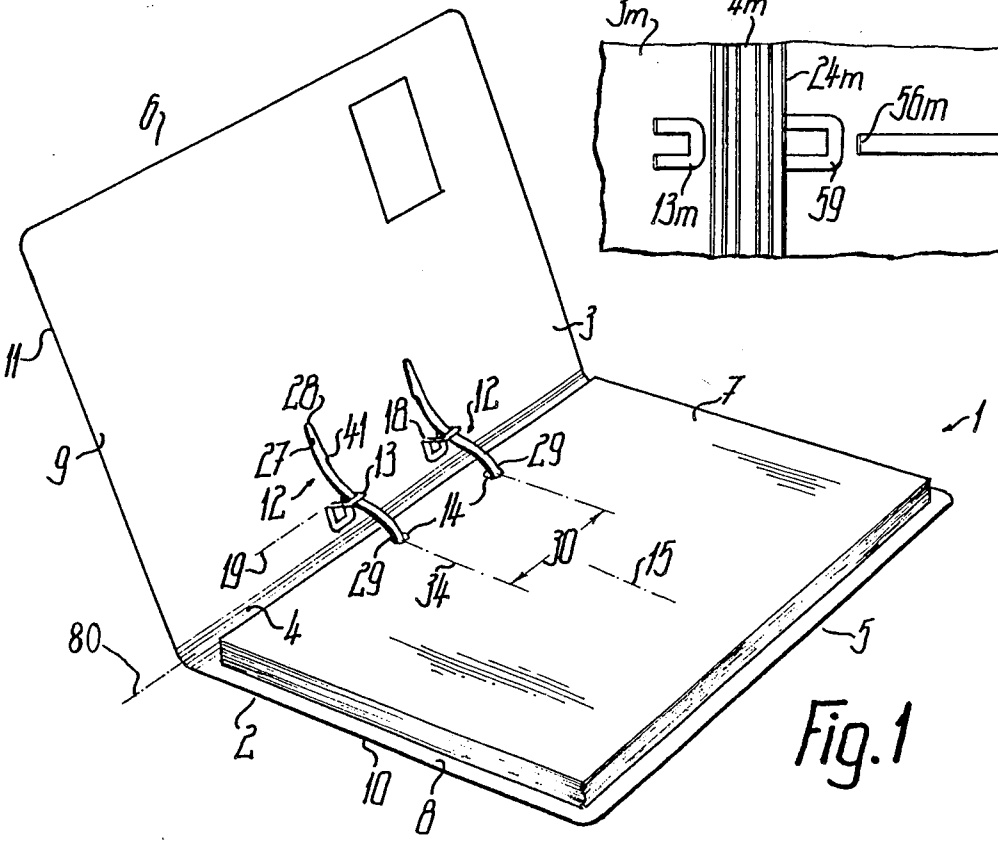
FIG. 1, a filling device according to the invention in perspective view and open state.

The filing device according to FIGS. 1 to 9 is constructed as a file in the form of a one-piece component made from a film, foil or sheet with a thickness between 0.3 and 1.6 and particularly below 1 mm, which is produced by a single punching-stamping cut, in such a way that at least all parts of the actual sequencing or fastening system are interconnected by one-piece connections. Two fastening sides, namely a sequencing side 2 and a counter-side 3 are openably and closably interconnected by means of a folding joint zone 4 and form in each case one file cover 5 or 6 and between said covers the sheet layer 7 to be filed can be completely covered.

The folding joint zone 4 formed from a plurality of juxtaposed joints in the manner of a link joint, forming the bending-elastic backs of predetermined width of the filing device, has a plurality of parallel joint axes. An imaginary central axis 80 located in the center of the width of the folding joint zone 4 and parallel to the joint axes is referred to hereinafter as the central axis of the folding joint zone 4, no matter whether in the vicinity of said central axis 80 there is a joint or a joint-free central portion of the folding joint zone 4 defined on either side by joints. Adjacent to the folding joint zone 4 on the insides 8, 9 of the two fastening sides is provided a sequencing or filing system, which essentially comprises two or more elongated, strip-like sequencing tongues 12 projecting from the inside 8 of the sequencing side 2 and two bow-like insert strips 13 projecting from the inside 9 of counter-side 3 for receiving said sequencing tongues 12. The sequencing tongues 12 are used for passing through the e.g. circular holes of a fastening hole system 14, which is generally provided at a predetermined distance from one edge of the sheet layers 7 and has the same distance between its holes in all the sheets. The sequencing system or its sequencing members are arranged in mirror symmetrical manner to a median plane 15 at right angles to the central axis 80, which is appropriately located in the center between the outer boundaries of the fastening sides which are parallel thereto.

Figure 2:
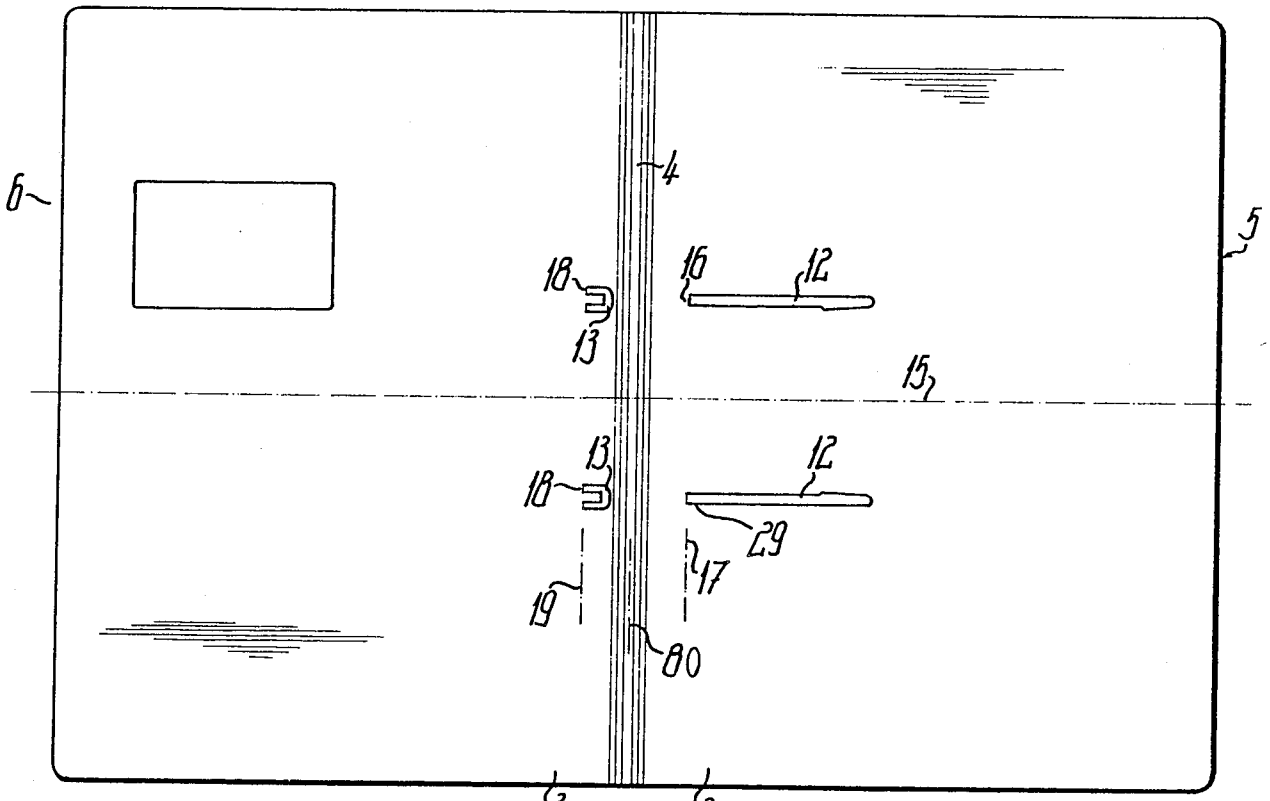
FIG. 2, the filing device according to FIG. 1 in the opened out state and a view of the inside.

The sequencing tongues 12 connected to the sequencing side 2 by means of in each case one tongue joint 16 with a tongue joint axis 17 parallel to central axis 80 and which are punched therefrom by a separating cut interrupted in the tongue joint and which produces no waste particles, project in the opened out position according to FIG. 2 over part of the width of sequencing side 2 from the folding joint zone 4 and at right angles thereto.

Their tongue joints 16 or common tongue joint axis 17 is at a distance from the adjacent boundary of the folding joint zone 4, which is roughly half larger than the mean spacing of the hole system 14 from the associated edge of the sheet layers. The insert strips 13 which are much shorter than the sequencing tongues 12 project in the opened out position in the same direction as tongues 12 freely from the strip joints 18, being located in a common strip joint axis 19 parallel to the tongue joint axis 14 or to the central axis 80. The insert strips 13 are also freely cut from the associated fastening side by a waste particle-free punching cut only interrupted in the vicinity of the strip joint 18 constructed as a double joint. However, the distance of the tongue joint axis 19 from the associated outer boundary of the folding joint zone 4 is smaller than the corresponding spacing of the tongue joint axis 17, but larger than the mean spacing of hole system 14 from the associated edges of the sheet layers 7.

When using the filing device 1, the sequencing tongues 12 and insert strips 13 are placed by the user roughly 180° around the insides 8, 9 of the fastening sides and as a result of the selected material and the joint constructions, they can remain roughly in a right-angled position following a resilient pivoting. All the joints are formed by joint slots 20 to 24, which are impressed in the blank surface parallel to one another from the outside 10, 11 in the manner of film hinge slots. Unlike the represented arrangement, the material behaviour of the blank generally leads to a slot-like depression forming in the vicinity of each impression on the inside 8,9 of the file, although instead of a profiled die being used as the counter-tool for the profiled stamping tool acting on the outside, a through, smooth, planar counter-face is used, which forms both the counter-tool for all the cutting dies and also for all the stamping tools constructionally combined therewith.

As a result of the cross-section left behind after stamping and which is reduced compared with the thickness of the starting foil, in the vicinity of the base surface of each joint slot, it results that the joint axes are located between the outer faces of the sheet, but are much closer to the insides 8, 9 of the fastening sides. The joint slots 22 to 24 of the folding joint zone 4 are provided in pairs on either side of the center of the width of the folding joint zone 4, the outermost joint slots 24 forming the outer boundaries of the folding joint zone 4.

Each of the two sequencing tongues 12 constructed in identical mirror-symmetrical manner to the median plane 15 forms a sequencing portion 25 directly connected to tongue joint 16 for engagement in the associated holes of hole system 14 of the sheet layers 7 engaging completely flat on the inside 8 of sequencing side 2, a longer displacement portion 26 formed by a continuous extension with the same cross-sections and an end portion 27 connected thereto and forming the free tongue end 28. The width of the sequencing portion 25 is e.g. almost a quarter smaller than the diameter of the hole system 14 of sheet layers 7. However, the two remote lateral edges 29 of the sequencing portion 25 of the two sequencing tongues running linearly and parallel to the median plane 15 up to the rounded tongue end 28 are at a distance from one another, which is essentially the same as the mean spacing 30 of the holes of hole system 14, plus the diameter of said hole system or is smaller than this by only a small clearance of motion. Thus, these lateral edges 29 form alignment edges for the sheet layers 7, so that parallel to the central axis 80 of the folding joint zone 4, they can perform no relative movements with respect to the sequencing tongues 12 and therefore the sequencing side 2. The length of those portions of the sequencing tongues 12 formed by the sequencing portion 25 is dependent on the thickness or height of the sheet layers 7 located on side 2, so that the portion of the particular sequencing tongue 12 projecting over the top surface of these sheet layers then forms the displacement portion 26.

The width of the displacement portion 26, which has common, parallel lateral edges 31, 32, which over the entire length or portion 26 are in one plane with the lateral edges of the sequencing portion 25, is the same as the width of the latter. Thus, sheets can be raised from the sheet layers 7 unhindered by the stack of the latter and can be moved backwards and forwards in sliding manner with the hole system thereof along the displacement portion 26 and can therefore be turned over accompanied by complete separation from the sheet layer stack and can then be turned back again. The displacement portion 26 simultaneously serves as a guide for sequencing sheets on the sequencing tongues 12 or on removing sheets therefrom.

Each insert strip 13 forms an in elevation rectangularly bounded sliding opening 33 which, with the strip 13 raised, is provided in a plane at right angles to the inside 9 of counter-side 3 and parallel to the central axis 80 and whose median plane 34 at right angles to central axis 80 coincides with the associated median plane of the displacement portion 26 or the sequencing portion 25. Each of the two bow legs 35 of insert strip 13 articulated by means of a separate strip joint 18 to the counter-side 3 forms with its inner edge a lateral boundary 37, 38 of the sliding opening 33. Over the clear height of insert strip 13, said lateral boundaries are parallel to one another and are located in planes at right angles to the inside 9 of the counter-side 3. The bow yoke 36 of insert strip 13 forms an outer boundary 39 parallel to the plane of the inside 9 of counter-side 3 and approximately linear to the lateral boundaries 37, 38. The inner transverse boundary of sliding opening 33 adjacent to counter-side 3 is directly formed by the inner face of counter-side 3. The clear width of sliding opening 33, which is slightly wider than the width of the bow leg 35, is only larger by a small motion clearance than the width of the displacement portion 26 of sequencing tongue 12, so that the boundaries 37 to 39 form sliding faces for the easy motion guidance of the lateral edges, as well as the outside of the displacement portion remote from the counter-side 3. The clear height of sliding opening 33 which is larger than the width and which is smaller than twice its width, is larger than the greatest width of the sequencing tongue 12 in the vicinity of end portion 27, or is at least sufficiently large to ensure that the corner diagonal dimension of sliding opening 33 is at least as large as said maximum width of end portion 27. The width of yoke 36 is roughly the same as that of the identically wide bow legs 35.

The maximum width of the sequencing tongue 12, which is in the vicinity of the transition of displacement portion 26 into end portion 27, results from a locking member 41 of an easily detachable locking system 40 provided on end portion 27 and which in the fastened position prevents the sequencing tongue 12 from being accidentally drawn out of the insert strip 13. The locking member 41, formed by a widening of sequence tongue 12, forms a locking shoulder 42 projecting over the lateral edge 32 of displacement portion 26 facing the in each case other sequencing tongue 12 and whose inner end 44 directly connects to the associated end of lateral edge 32 and emanates in approximately right angled manner from the latter and is e.g. pitch circular in a convex arc. An insertion edge 46 converging with the lateral edge 31 in acute-angled manner to the free tongue end emanates from the projecting end 45 of locking shoulder 42 and forms the associated lateral edge of end portion 27 running rectilinearly up to the rounded tongue end 28. The counter-member 43 for locking member 41 is formed by that edge of the lateral boundary 38 of sliding opening 33 which, with raised insert strip 13, is located on its side remote from the folding joint zone 4. The angle of inclination of locking shoulder 42 which decreases outwards due to the arc shape is chosen in such a way that, if the locking member 41 is drawn by a small amount into the sliding opening 33 under the tensile loading of sequencing tongue 12, there is no jamming or self-locking between tongue 12 and strip 13 and instead the sequencing tongue 12 under shear stress is longitudinally moved in the direction towards the free tongue end 28 without any resistances greater than the sliding resistances between the displacement portion 26 and the insert strip 13 with respect to the latter, that the locking shoulder 42 is detached in resistance-free manner from insert strip 13. The greatest width of the sequencing tongue 12 in the vicinity of the locking member 41 is smaller than the width of strip 13 and is preferably roughly half as large, so that the locking member 41 projects over the lateral edge 32 by less than the width of a bow leg 35.

Since with increasing length of the sequencing tongue 12 between tongue joint 16 and locking member 41, the compression member action thereof decreases, in order to maintain this action even in the locking position, this length is slightly smaller than the arc formed, articulated connection of the sequencing tongue 12 to the sequencing side 2. Thus, the bending-elastic, resilient sequencing tongue 12, in the case of the locking member 41 engaging in insert strip 13 in the locking position, as a result of its residual stress and optionally supported in the hole system 14 by the sheet layer 7, forms in side view an upwardly curved arc, which has a decreasing radius of curvature from sequencing side 2 to insert strip 13 and in the vicinity of the latter passes into an oppositely curved shallow arc due to resilient engagement on boundary 39 and by resilient supporting in the area of the free tongue end 28 on the inside 9 of counter-side 3. Thus, top sheets of sheet layers 7 can be easily turned over onto insert strip 13. On turning back these sheets, the sequencing tongue 12 is tensile stressed, so that when locking shoulder 42 engages on counter-member 43, despite clearance motions of locking member 41 with respect to insert strip 13, it is ensured that the sequencing tongue 12 can be detached from said strip. When closing the filing device according to FIGS. 5 and 6, the sequencing tongue 12 slides in the vicinity of its tongue end 28 along a slideway 48 formed by the inside 9 of counter-side 3 and with its associated surface on boundary 39 of sliding opening 3, so that the sliding engagement is ensured by the slight resilient pretension of sequencing tongue 12. In the closed state, sliding opening 3 is located in a substantially congruent manner over hole system 14 of sheet layer 7 or over tongue joint 16.

Figure 4:
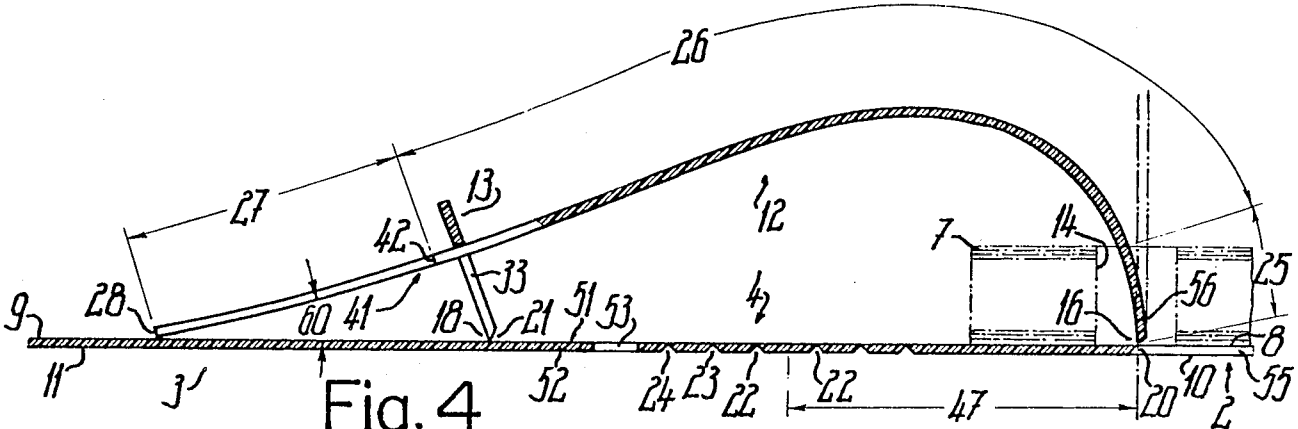
FIG. 4, a section through the arrangement according to FIG. 3.
Figure 3:
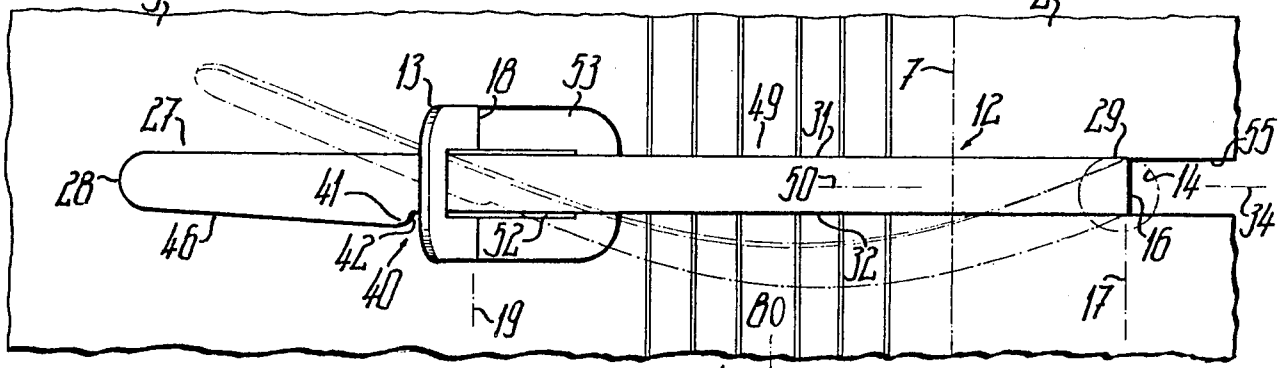
FIG. 3, a detail of FIG. 2, but with the sequencing tongue in the fastening position and on a larger scale.
Figure 5:
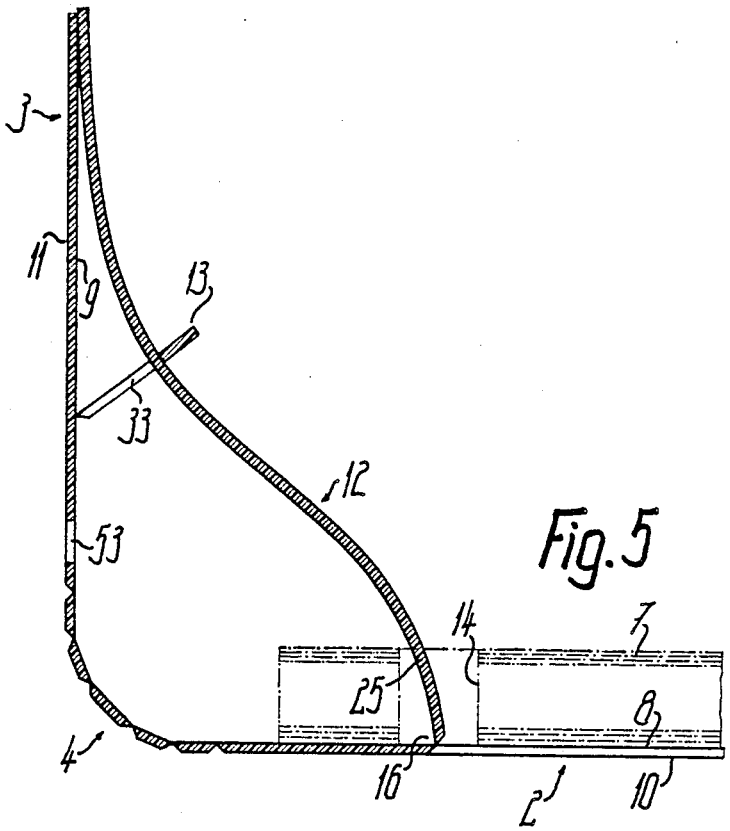
FIG. 5, the arrangement according to FIG. 4 but with the counter-side in the half-closed state.
Figure 6:
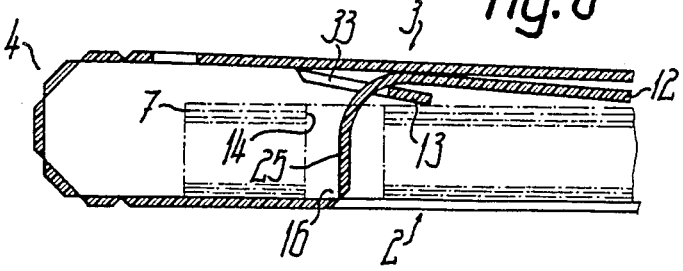
FIG. 6, the arrangement according to FIGS. 4 and 5, but with the counter-side in the completely closed state.
Figure 7:
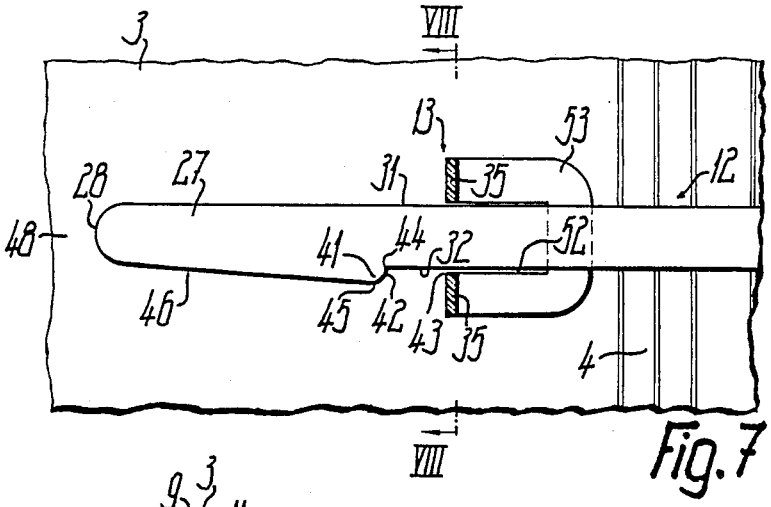
FIG. 7, a detail of FIG. 3, but with a cut insert strip raised at right angles to the counter-side.
Figure 8:
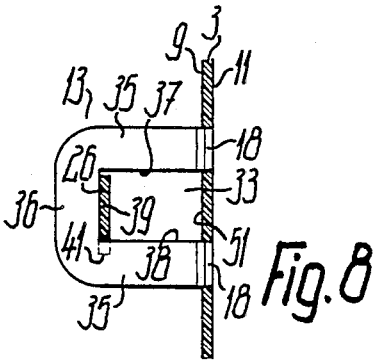
FIG. 8, a section along line VIII—VIII of FIG. 7.

For unlocking the easily detachable locking systems 40, each sequencing tongue 12 has a handle 49, which is merely formed by a portion of at least one lateral edge 31 or 32 of tongue 12. If both in the access position of fastening side and in the fastened position, sequencing tongue 12 according to FIGS. 3 and 4 is pressed against a lateral edge 31 or 32 of displacement portion 26 of sequencing tongue 12, portion 26 escapes this force in the associated direction, so that the portion of sequencing tongue 12 following onto tongue end 28 resiliently turns about its median longitudinal axis 50 under the forces which occur, so that the locking member 41 tilts into a diagonal position with respect to sliding opening 33, accompanied by the continued engagement of tongue end 28 on the inside 9 and is consequently free from counter-member 43. The deflection of displacement portion 26 due to the compressive force applied simultaneously brings about a reduction of the spacing between tongue joint 16 and locking member 41, so that the latter is then removed from insert strip 13 and the sequencing tongue is also freed from the latter. FIG. 3 shows in dot-dash form a position of sequencing tongue 12, which is assumed when it is pressurized on the longitudinal side remote from locking member 41 for unlocking purposes. Sequencing tongue 12 then twists in such a way that the locking member 41 swings in the direction of the inside 9 of sequencing side 3, so that the rectilinear lateral edge 31 slides up to the tongue end 28 on boundary 39 of sliding opening 33. This also prevents the hole system 14 from being positioned so eccentrically that the sequencing portion 25 has a certain motion clearance with respect to the sheet layers 7 in this direction. As lateral edges 31 are the remote lateral edges of the two jointly locked sequencing tongues 12, the unlocking can simultaneously be carried out very easily with the fingers of one hand, e.g. with the thumb and index finger by oppositely directed compressive stressing. If sequencing tongue 12 is pressurized in the vicinity of the other lateral edge 32 for unlocking purposes, then locking member 41 swings in the opposite direction away from the inside 9 of counter-side 3 and jumps over the boundary 39 of sliding opening 33, which passes in a relatively acute-angled manner into the lateral boundaries 37, 38.

The slideway 48 for sequencing tongue 12 has an extension in the form of a slideway 51 projecting slightly over the raised insert strip 13 towards the folding joint zone 4 and passing through sliding opening 33. The width of slideway 51 aligned with sliding opening 33 is the same as the width of the latter and is formed by a freely projecting guide tongue 52. Guide tongue 52 results from a waste particle-free separating cut for punching out the insert strip 13 and forms that part of said cut used for forming sliding opening 33. The bow-like strip cutout 53 in counter-side 3 formed by the separation of insert strip 13 is bounded on the inside of its bow leg 54 by guide tongue 52, whose free end is at a relatively small distance from the transverse boundary of cutout 53 in the plane of counter-side 3 and is connected by its tongue heel in joint-free manner to the remainder of counter-side 3. On inserting the free end of sequencing tongue 12 into insert strip 13, tongue 12 can easily be placed on slideway 51 of guide tongue 52 and then inserted under shear stress into sliding opening 33. In the vicinity of free tongue end 28, the sequencing tongue is narrower than in the vicinity of displacement portion 26. As a result of the separating cut forming the particular sequencing tongue 12, a tongue cutout 55 is formed in the sequencing side 2. The particular sequencing tongue 12 is connected to the sequencing side by a tongue heel 56, which forms or is formed by the associated end section of the sequencing portion 25.

Figure 21:
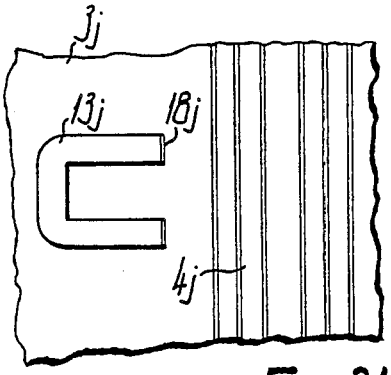

As a result of the the dimensional relationships within the sequencing tongue 12 on the one hand and the insert strip 13 on the other, for a given bending rigidity, it is possible to influence to what extent the tongue 12 in each position is merely stressed as a non-bending compression member. Usually, for this purpose a very high insert strip 13 or sliding opening 33 is sought, so that (as placement close to the associated outer most joint slot 24 is undesired in most cases), the insert strip 13 or outer transverse boundary 39 of sliding opening 33 is placed at a relatively long distance from the folding joint zone 4 when the insert strip 13 is completely placed round. This position of the outer transverse boundary is also important for the closed state of the filing device 1, because the transverse boundary 39 must have a distance from the folding joint zone 4, which is larger, e.g. by slightly more than half the hole system diameter, than the same spacing of the tongue joint 16, so that sequencing tongue 12 with the fastening sides 2, 3, closed from tongue joint 16 or sequencing portion 25, passes via a large arc, which is therefore not critical for permanent deformations, into the displacement portion 26 or passes through sliding opening 33. The spacing of tongue joint 16 from folding joint zone 4 is to be kept small enough to ensure that no unnecessary space is lost between the associated edges of sheet layers 11 and zone 4. In many cases the construction according to FIG. 21 is particularly favourable.

As the behaviour of the sequencing tongue 12 as a non-bending, but curved compression member is also directly dependent on the maximum bending length occurring in the open access position of filing device 1 and with the sequencing tongue 12 in the fastened positioned, i.e. the length between the sliding support on insert strip 13 and the support in the vicinity of the hole system 14 of sheet layer 7 or the tongue joint, locking system 40 forms that boundary for the length of the displacement portion 26, optionally plus the length of sequencing portion 25, which prevents a drawing out of the sequencing tongue 12 from insert strip 13 over a critical amount for the bending leading to a lengthening of the portion acting as a compression member.

As can be gathered from FIG. 4, it is also important for the loading of sequencing tongue 12 as a compression member which frictional resistances act on it on the side remote from the engagement on the transverse boundary 39 of sliding opening 33 in the vicinity of tongue end 28 when end portion 27 slides on or in the vicinity of tongue end 28 on the inside 9 or slideway 48. These frictional resistances increase with the acute angle 60 under which the end portion 27 is connected to counter-side 3, which is maximum in the locking position and is also dependent on the length of end portion 27. Acute angle 60 must be well below 45° or smaller than 30° or 20° and it particularly approximately 15° and is e.g. given a favourable value if the length of end portion 27 is roughly 2½ to 3 times the height of the transverse boundary 39 of opening 33 over slideway 48. These values particularly apply to the widened fastening sides 2, 3 according to FIG. 4, because here angle 60 is at a maximum. Due to their self-raising, resilient characteristics, also in the access position, counter-side 3 follows an S-shaped curve from the folding joint zone 40 upwards and then downwards again on the other side of tongue end 28.

In FIGS. 10 to 23, corresponding parts are given the same reference numerals as in FIGS. 1 to 9, but different letter references are used.

Figure 10:
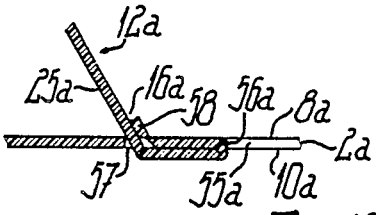
FIG. 10. another embodiment of the connection of a sequencing tongue in a larger scale, sectional representation.
Figure 9:
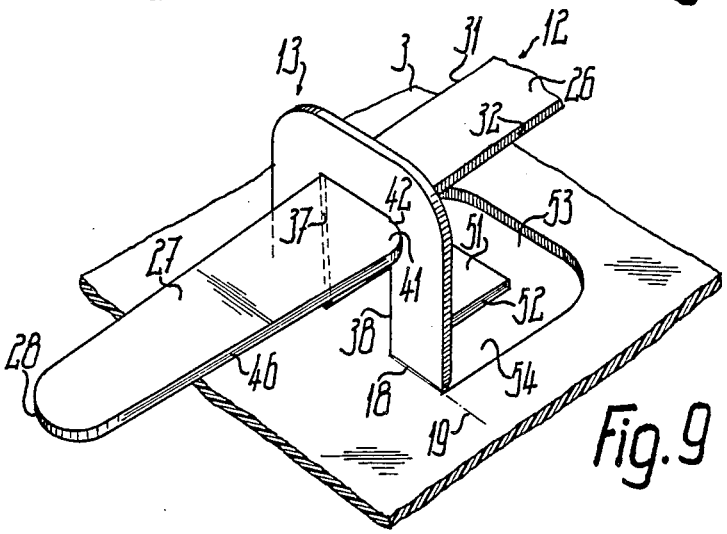
FIG. 9, a detail of FIGS. 7 and 8 in perspective view.

In the embodiment according to FIG. 10 on the side of the one-part transition or connection of tongue heel **56*a* of sequencing tongue 12*a* into sequencing side 2*a* facing the folding joint zone is provided a through-opening 57 aligned with the longitudinal direction of the sequencing portion 25*a* and whose width is the same as that of portion 25*a* and which is formed by a waste particle-free, U-shaped separating cut with cut legs directed towards the tongue cutout 55. The length of said legs is the same or slightly larger than the material thickness of sequencing tongue 12*a*, through-opening 57 being at a distance from the folding joint zone. For use purposes, sequencing tongue 12*a* is not only turned up from its opened out position towards the inside, but also towards the outside 10*a* of sequencing side 2*a* and then is passed with its free end from outside 10*a* through the through-opening 57 and is so drawn against the inside 8*a* of sequencing side 2*a* that its portion located on the outside 10*a* of sequencing side 2*a* between tongue heel 65*a* and through-opening 57 engages closely on said outside. Due to the U-shaped separating cut, a strip tongue 58 is formed which, on drawing through the sequencing tongue 12*a*, is turned up towards the inside 8*a* of sequencing side 2*a* and engages with pretension on the surface of tongue 12*a* remote from the folding joint zone in the vicinity of the inside 8*a* of sequencing side 2*a*. Thus, strip tongue 58 forms a support member for sequencing tongue 12*a* in the vicinity of its articulated connection to sequencing side 2a on the inside of through-opening 57, tongue 58 tensioning tongue 12a in this area against the facing boundary of through-opening 57. In this area the sequencing tongue 12a can be provided with a film hinge-like tongue joint, or the tongue joint 16a is obtained without any change to the tongue cross-section being necessary in that the sequencing tongue is supported on the edges of through-opening 57 and on strip tongue 58** in knife edge support-like manner.

Figure 11:
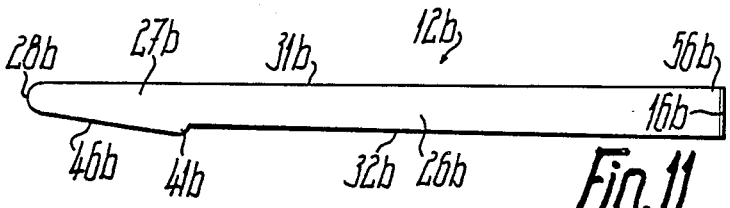
FIGS. 11 to 14, further embodiments of the sequencing tongues in plan view.

Sequencing tongue 12b according to FIG. 11 has a lateral edge 32b belonging to locking member 41b, which from tongue joint 16b to locking member 41b converges in a rectilinear manner under an angle of a few degrees in the direction of tongue end 28b with the other lateral edge 31b, so that from tongue heel 56b there is a gradual reduction in the width of the sequencing portion and the displacement portion 26b.

Figure 12:
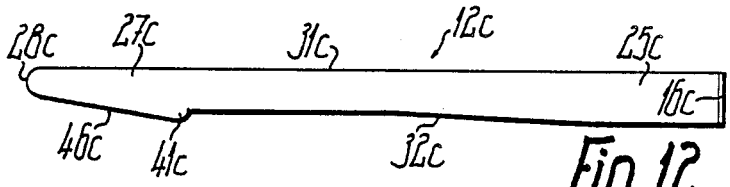
Figure 13:
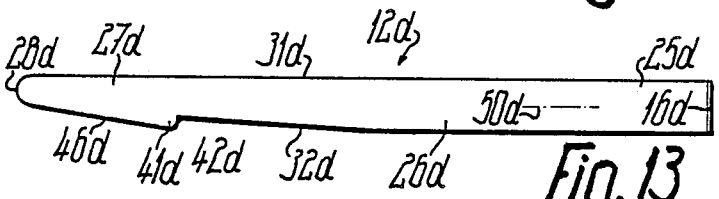

In the embodiment according to FIG. 12, the sequencing portion 25c has a constant width, whilst the lateral edge 32c between sequencing portion 25c and locking member 41c is inclined as described in FIG. 11. The inclined lateral edge 32d according to FIG. 13 only extends over part of the length of displacement portion 26d from locking member 41d. As shown in FIG. 13, locking shoulder 42d can be approximately at right angles to the median longitudinal axis 50d.

Figure 14:
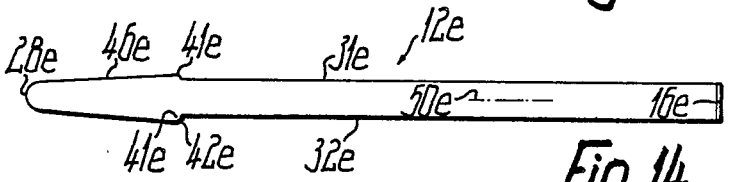

Sequencing tongue 12e according to FIG. 14 has two locking members 41e with in each case one locking shoulder 42e projecting in mirror symmetrical manner over both lateral edges 31e, 32e, so that the sequencing tongue 12e is symmetrical to its median longitudinal axis 50e. A sliding opening is appropriately provided for said sequencing tongue 12e and its width increases from the outer transverse boundary towards the boundary through the counter-side to the width of the sequencing tongue 12e in the vicinity of locking members 41e. Thus, sequencing tongue 12e locked under its own pretension on the transverse boundary only has to be pressed down in the vicinity of the displacement portion until the locking members 41e reach the wider area of the sliding opening, after which the sequencing tongue 12 is freed from the insert strip by pulling on the displacement portion.

FIG. 15f shows an insert strip 13f with such a widened sliding opening 33f that it is also suitable for the sequencing tongues according to FIGS. 1 to 13. Widening is obtained in that one of the two lateral boundaries of sliding opening 33f slopes accordingly.

Figure 16:
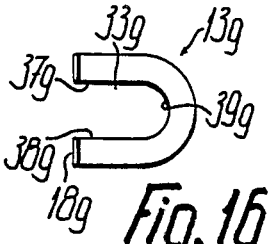
FIGS. 15 and 16, two further embodiments of insert strips in elevation.
Figure 15:
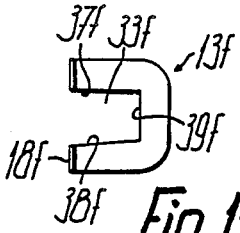

In the embodiment according to FIG. 16, which is particularly suitable for the sequencing tongue 12e according to FIG. 4, the widening of sliding opening 33g results from a semicircular transverse boundary 39g with parallel lateral boundries 37g, 38g.

Figure 17:
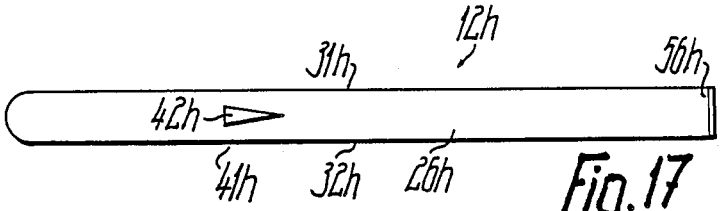
FIG. 17, another embodiment of a sequencing tongue in plan view.
Figure 18:
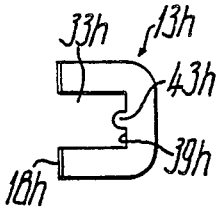
FIG. 18, an elevation of the insert strip particularly provided for the sequencing tongue according to FIG. 17.
Figure 22:
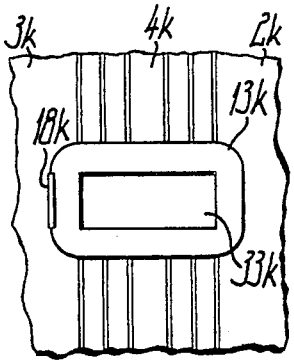
FIGS. 21 and 22, two further embodiments of insert strips in elevation.

The sequencing tongue 12h according to FIG. 17, which is particularly suitable for an insert strip 13h according to FIG. 18 has the same constant width over its entire length and has as a locking member 41h an all-round closed locking opening 42h located in the center of its width between the lateral edges 31h, 32h thereof, with which is associated a locking disk cam 43h in the transverse boundary 39h of sliding opening 33h of insert strip 13h. The locking opening 42h, triangularly tapering in acute-angled manner in the direction of tongue heel 56h, is at least partly traversed by cam 43h in the locking position and in the case of tensile stressing of the displacement portion 26h, the locking disk cam 43h engages on the transverse boundary of locking opening 42h and in the case of shear stressing can be easily detached therefrom as a result of the triangular construction of said opening 42h. Dispacement portion 26h merely has to be pressed downwards for unlocking purposes.

Figure 19:
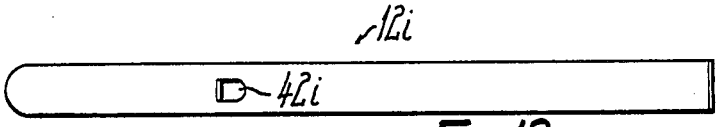
FIG. 19, another embodiment of a sequencing tongue in plan view.
Figure 20:
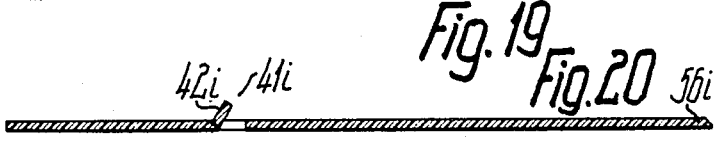
FIG. 20, a longitudinal section through the sequencing tongue of FIG. 19.

In the embodiment according to FIGS. 19 and 20, the sequencing 12i has as the locking member 41i a waste particle-free-punched locking tongue 42i, which projects freely out towards the tongue heel 56i in the opened out position and is so raised with respect to sequencing tongue 12i that it engages with the bow yoke of the insert strip in the locked position. It is here again merely necessary to press down the displacement portion of sequencing tongue 12i for unlocking purposes.

The insert strip 13j according to FIG. 21 is arranged in such a way that it is directed away from the folding joint zone 4j in the opened out position. According to FIG. 22 the insert strip 13k in the opened out position is also located in the vicinity of the folding joint zone 4k, i.e. is punched therefrom, strip 13k projecting freely towards the tongue heel of the associated sequencing tongue in this position and has on its side remote from said tongue heel the preferably single strip joint 18k. The insert strip 13k is not bow-like and is instead elongated or elongated, rectangular, circular, so that it uninterruptedly surrounds on all sides the sliding opening 33k.

Following onto lateral edge 32, the locking shoulder can e.g. be rectilinear over part of its length. In this case, the tip of the locking member is appropriately rounded in such a way that the rounded portion passes tangentially into the insertion edge 46. Due to the sloping or rounded locking shoulder 42, it is particularly easy to unlock the sequencing tongue and draw it out of the hole system 14 of the sheet layer 7.

As shown in FIG. 23, it is also possible to separate from the filing device holding rings 59 constructed in one piece therewith and which are preferably also arc-shaped, so that they can be produced without waste particles. These holding rings 59 can e.g. be provided in the hole system grid and adapted to the filing dimensions of said hole system, so that the complete filing device can be received in another filing device or the like. The holding rings 59 to be raised from the opened out position towards the outside of the filing device are aligned with the sequencing tongues 12m, one holding ring 59 being in each case provided between a tongue heel 56m and the folding joint zone 4m. In the opened out position, holding rings 59 project freely in the direction of tongue heel 56m, whilst the ends of their bow legs can be located in the vicinity of the folding joint zone 4m, particularly the associated outermost joint slot 24m, so that the holding ring 59 also passes via a joint into the filing device, without a separate joint slot being required.

The inventive filing device is particularly suitable when sheet layers are not only to be held together in the manner of a permanent combination, but also where it is required to constantly remove sheets, i.e. where it is frequently necessary to replace sheets and easily thumb through the filed sheet layers. At least one of the fastening sides or one of the file covers can be provided with an e.g. rectangular window, which is appropriately arranged in the upper file cover 6 according to FIG. 1. When using a sheet which is positioned at the top in the filing device and having a correspondingly simple inscription, it is possible to forego a separate label inscription on the outside of the particular filing device. The corners of the file cover are preferably rounded for protection purposes.

What is claimed is:

1. A folder for retaining punched sheets, comprising:

an integral one piece folder cut out from a flat sheet of bendable material which springs back from bending deformation, the folder having two side-pieces joined at a central folding joint zone defining a center line, the two side-pieces being foldable together and apart around the center line thereby to cover and to uncover the sheets when placed in the folder;

at least one filing tongue also cut out from the flat sheet of bendable material and integral with the side-pieces, the filing tongue being dimensioned and positioned to extend through a punched hole in the punched sheets and thereby to retain the sheets in the folder, the filing tongue being articulated to one of the side-pieces by a hinge defining a tongue joint axis parallel to the center line and spaced from the center line;

a receptacle bow defining an insert strip for receiving the filing tongue, the receptacle bow also being integrally cut out from said flat sheet, the receptacle bow being a generally U-shaped piece articulated at its ends to the other of said two side-pieces at a weakened hinge defining a strip joint axis parallel to the center line and spaced from the center line by a distance at least only slightly less than a distance between the tongue joint axis and the center line, the receptacle bow being folded upwardly from said other of the two side pieces and away from the center line, the receptacle bow slidably receiving the filing tongue and an inner surface of the receptacle bow defining a transverse boundary for the filing tongue spaced farther from the center line than the tongue joint axis is spaced from the center line;

The filing tongue sliding freely through the receptacle bow due to forces along the filing tongue, as the folder is opened and closed, the receptacle bow being folded over towards said other of the two side pieces when the folder is closed, whereby the filing tongue remains substantially straight against said other of the two side pieces, being pushed as a non-folding compression member through the receptacle bow as the folder is closed.

2. A filing device for sheet layers (7) that have punched holes (14) for receiving filing tongues (12), said filing device (1) comprising:

a foldable member severed in one piece from a flat, flexible blank having a substantially constant thickness, said folding member being a pattern cut out from the blank;

two device side-pieces (2,3) movably connected about a folding joint zone (4), the side-pieces being movable with respect to each other into relative positions by opening and closing movements between an opened access position and a folded closed position, said side-pieces (2,3) having inside faces (8,9) opposing each other in the closed position, said side-pieces (2,3) being formed by said foldable member and each side-piece (2,3) defining a plane;

a first one of said side-pieces (2) being a filing side-piece (2);

at least two filing tongues (12) provided on said filing side-piece (2), the filing tongues (12) tending to spring back from bending deformation, said filing tongues (12) defining a longitudinal direction and having cross-sections adapted for transit through the punched holes (14) of the sheet layers, each filing tongue (12) having a hole engaging portion (25) for engaging in an associated hole (14) and having a longitudinal axis (50);

a second one of said side-pieces (3) defining a plane and forming a counter side-piece (3) having an insert strip means (13), said insert strip means (13) when in an insert position defining an insert opening (33) for each respective filing tongue (12), said insert strip means (13) being pivotable about a strip joint axis (19) of a strip hinge (18) from a folded down position towards the insert position, said insert strip means (13) being constructed in one piece with the filing tongue (12);

said filing tongues and said insert strip means having ends attached to the side pieces (2,3) at a space from the folding joint zone, whereby folding the side pieces together moves said ends toward one another, said filing tongue (12) being movable from an inserting position into a filing position by inserting a longitudinal portion (26) of said filing tongue (12) into said insert opening (33), and wherein slide means are provided for guiding said filing tongue (12) in said insert strip means (13), the filing tongue (12) being unfoldable and slidable through the strip means due to said closing movements, said slide means being provided by a combination of:

said insert opening (33) being wider than the cross-sections of the filing tongue (12), at least at said longitudinal portion (26), thereby forming a slide opening for receiving said longitudinal portion (26) having a free clearance of such an extent that said longitudinal portion in each of said closing movements of the side-pieces (2,3) is displaceable against low sliding resistances in the longitudinal direction through the insert strip means (13), said filing tongue (12) forming a bending elastic compression member having resilient bending properties for resiliently returning from each of said bending deformations and being resiliently pretensioned to remain in the filing position, said compression member with respect to the filing said-piece (2) being supported against sliding resistances, the insert means (13) forming separate substantially bow-like boundary edges (37,38,39) of the slide openings (33) for the filing tongues (12), said boundary edges (37,38,39) forming inner edges (37,38) of bow legs (35) having ends, and, adjacent the slide opening (33), the counter side-piece (3) having a slideway (48,51) for closing movements of the filing tongue (12), said slideway (48,51) being substantially in a plane of the counter side-piece (3) said slide way (48,51) extending in a sliding direction corresponding to the opening and closing movements of the filing tongue (12) substantially up to the slide opening (33) on at least one side of the insert strip means (13), when in the insert position.

3. A filing device according to claim 2, wherein the filing tongue (12) has a tongue heel (56) adjacent a connection to the filing side-piece (2), a tongue hinge (16) being defined at the connection, said tongue hinge (16) forming a single tongue hinge axis (17) substantially parallel to a center axis (80) of the device at the folded joint zone (4), said tongue hinge axis (17) being located substantially in a plane defined by the inside face (8) of the filing side-piece (2), said tongue hinge axis (17) being immoveable both with respect to the filing tongue heel (56) and the filing side-piece (2).

4. A filing device according to claim 3, wherein the tongue hinge (16) of the tongue heel (56) is constructed in the manner of a film hinge, said film hinge being bounded on at least one side of the filing side-piece by an inner face of a hinge slot (20).

5. A filing device according to claim 3, wherein the filing tongue (12) forming the compression member stressed by the sliding resistances is secured when compressed by a pre-determined bending resistance of the tongue hinge (15), said tongue hinge (16) being operable to define a maximum swivel angle of the tongue heel (56), said tongue hinge (16) being spring biased in a monostable manner substantially to a central position over a much smaller swivel angle than the maximum swivel angle of the tongue heel (56).

6. A filing device according to claim 2, wherein said longitudinal portion (26) of the filing tongue (12) has a portion end directed towards a free end (28) of the filing tongue (12) said portion end being located at a distance from said free end (28).

7. A filing device according to claim 2, wherein the filing tongue (12) has a locking member (41) of an easily releasable locking means (40) defining at least one locking position of the filing tongue (12), said locking member (41) running up as a stop member against a counter member (43) of the counter side-piece (3) at an end of the filling position when moving the filing tongue (12) towards the inserting position, said locking member (41) in each locking position being movable transversely to the longitudinal axis (50) of the filing tongue (12) into an unlocking position with respect to the counter member (43).

8. A filing device according to claim 7, wherein a manual actuating member (49) is provided for transferring the locking member (41) into the unlocking position, said actuating member (49) being formed by a resilient biased curved portion (26) of the filing tongue located between the slide opening (33) and the hole engaging portion (25) when the device is positioned in the filing position.

9. A filing device according to claim 7, wherein the filing tongue (12) is torsionally twistable for unlocking substantially about the longitudinal axis (50) and is biased to return when released, a press-handle-like actuating member (49) being provided for twisting the filing tongue (12), said actuating member (49) being constituted by at least one lateral edge of said longitudinal portion (26) of the filing tongue (12), said longitudinal portion (26) extending freely between the tongue heel (56) and the slide opening (33) in the opened access position.

10. A filing device according to claim 7, wherein the counter member (43) of the easily releasable locking means (40) for the filing tongue (12) is formed by a boundary of the slide opening (33) provided in the insert strip means (13), said locking member (41) of the filing tongue (12) having at least one locking shoulder (42) facing towards said tongue heel (56) when the filing tongue (12) is in an extended position, said locking shoulder (42) being provided on an end of the locking member (41) facing the tongue heel (56), said counter member (43) being formed by a side of the insert strip means (13) remote from the tongue heel (56) when the insert strip means (13) is in the opened access position (7).

11. A filing device according to claim 10, wherein the locking shoulder (42) has a length extension, said locking shoulder (42) over at least a part of said length extension diverging by an angle with respect to the longitudinal axis (50) towards and free end (28) of the filing tongue (12), said angle being larger than an angle at which the locking shoulder is nonreversibly self-locking when the locking member (41) engages in the slide opening.

12. A filing device according to claim 10, wherein the locking shoulder (42) has a projecting end (45) and a set lock end (44), said locking shoulder (42) being formed by a lateral edge (32) of the filing tongue (12), said set back end (44) of the locking shoulder (42) being directly connected to a lateral edge (32) of said longitudinal portion (26) of the filing tongue (12), said lateral edge (32) being located substantially in the longitudinal direction of the longitudinal portion (26), said longitudinal portion (26) in the vicinity of the locking shoulder (42) having a width smaller than a width of the slide opening (33) by a limited clearance allowing motion of the longitudinal portion (26) in the slide opening (33), the filing tongue (12) adjacent the projecting end (45) of the locking shoulder (42) having a locking width, said locking width being larger with respect to said width of the slide opening (33) substantially by an amount by which the locking shoulder (42) is projects, said locking width being substantially as large as an inner width of the punched holes (14).

13. A filing device according to claim 2, wherein the insert strip means (13) is pivotable to lie on the inside (9) of the counter side-piece (3), said insert strip means (13) being separated out of the counter side-piece (3) along at least one cutting line, said insert strip means (13) being pivotably mounted on the counter side-piece (3) about the strip hinge (18), said strip hinge axis (19) being located substantially parallel a to a center axis (80) of the device at the folding joint zone (4).

14. A filing device according to claim 2, wherein the insert strip means (13) is formed by separate insert strips (13) for the filing tongues (12), each respective insert strip (13) being substantially bow-like and U-shaped, thereby forming bow legs (35) and inner edges, ends of the bow legs being articulated to the counter side-piece (3), said inner edges forming boundary edges of the slide opening (33).

15. A filing device according to claim 2, wherein the insert strip means (13) when in a folded down position in the plane of the counter side-piece (3), projects towards the folding joint zone (4) and towards the tongue heel (56) of the filing tongue (12).

16. A filing device according to claim 2, wherein the insert strip means (13) is pivotable about a maximum swivel angle with respect to the counter side-piece (3), said insert strip means (13) being spring biased in a substantially monostable manner to the inserting position at least within a limited swivel angle substantially smaller than the maximum swivel angle, said insert strip means (13), when in the inserting position, being located transversely to the plane of the counter side-piece (3).

17. A filing device according to claim 2, wherein the strip hinge axis (19) and the slide opening (33) are spaced from a center line of the folding joint zone (4), said spacing being substantially at most as large as a spacing between the tongue hinge axis (17) and the center line when the insert strip (13) is raised at right angles to the counter side-piece (3).

18. A filing device according to claim 2, wherein the insert strip means (13) except for its connection to the counter side-piece (3) is separated from remaining portions of counter side-piece (3) by a cut free of wasted particles, thereby providing a strip cutout opening (53) in the counter side-piece (3), said cutout opening (53) being congruent with a shape of the insert strip means (13).

19. A filing device according to claim 2, wherein the strip hinge (18) of the insert strip means (13) is constructed as a film hinge, said film hinge being bounded on at least one side of the counter side-piece (3) by an inner face of a hinge slot (21).

20. A filing device according to claim 2, wherein said slide way (48,51) is at least partially formed by a guide tongue (52) bounding a bow-shaped strip cutout defining the slide opening (33) on an inside and by a following part of the inside (9) of the counter side-piece (3).

21. A filing device according to claim 2, wherein the slide opening (33) has a transverse boundary (39) and an area following up to said transverse boundary at least over said area, the slide opening (33) having substantially parallel lateral boundaries (37, 38) passing substantially in an acute-angled manner into the transverse boundary (39).

22. A filing device according to claim 2, wherein the slide opening (33) has a lateral width and a height in a direction transverse to said lateral width, said height of the slide opening (33) being substantially larger than a cross-sectional thickness of the filing tongue (12) and also at least as large as a locking width of the filing tongue (12).

23. A filing device according to claim 2, wherein the hole engaging portion (25) of the filing tongue (12) provided for engaging in the punched holes (14) is at least as wide as said longitudinal portion (26), said filing tongue (12) having a constant width between the locking member (41) and the tongue heel (56) and having rectilinear lateral edges when in a stretched state.

24. A filing device according to claim 2, wherein the filing tongue (12), when in a locking position, has a length extension between the filing side-piece (2) and a portion engaging the insert strip means (13), said length extension being smaller than an arc length of a semicircle having a radius equal to a spacing of the center line of the folding joint zone (4) from the tongue heel (56) of the filing tongue (12).

25. A filing device according to claim 2, wherein the filing tongues (12) have locking members (41) on facing lateral edges (32) thereof.

26. A filing device according to claim 2, wherein individual ones of said punched holes (14) are located on either side of a punching median plane (15) at a mean hole distance (30) from each other, two lateral edges (29) of two filing tongues (12) forming aligning edges for the sheet layers (7), said aligning edges (29) being located at a distance from one another differing from said mean hole distance (30) substantially by an inner width of the punched holes (14).

27. A filing device according to claim 19, wherein two remote aligning edges (29) of two laterally outermost filing tongues (12) are spaced by a distance substantially as large as said mean hole distance (30) plus the inner width of the punched holes (14).

28. A filing device according to claim 26, wherein the filing tongues (12) have locking members (41) on lateral edges (32) remote from the aligning edges (29).

29. A filing device according to claim 2, wherein the filing tongue (12) apart from a connection with the filing side-piece (2) is integral in one piece with the filing side-piece (2) and separated therefrom by a cut free of waste particles, thereby providing a tongue cutout opening (55) in the filing side-piece (2) said cutout opening (55) being congruent with a shape of the filing tongue (12).

30. A filing device according to claim 2, wherein the filing tongue (12*a*) has an inner end portion extending from a conjunction point to the filing side-piece (2*a*), means being provided for arranging said inner end portion on an outside (10*a*) of the filing side-piece (2*a*) from said conjunction point to a through-opening (57) provided closer to the folding joint zone than said conjunction point and for inserting said inner end portion through said through-opening (57), the tongue hinge (16*a*) being thereby disposed in a vicinity of the through-opening (57) on the inside (8*a*) of the filing side-piece (2*a*).

31. A filing device according to claim 2, wherein the filing side-piece (2) and the counter side-piece (3) pass into one another by means of at least one folding hinge slots (18, 20), said hinge slots (18, 20) being provided on a same side as all hinge slots (22, 23, 24), said insert strip means (13) extending in the opened access position cloe to a folding hinge slot (24) adjacent to the insert strip means (13).

32. A filing device according to claim 2, wherein the filing side-piece (2) and the counter side-piece (3) are made from a polypropylene sheet.

* * * * *

UNITED STATES PATENT AND TRADEMARK OFFICE

CERTIFICATE OF CORRECTION

PATENT NO. : 4,784,507

DATED : November 15, 1988

INVENTOR(S) : Hans Vetter

It is certified that error appears in the above-identified patent and that said Letters Patent is hereby corrected as shown below:

Column 1, line 52 after "manually" insert a comma.

Column 6, line 21 delete "filling" and insert --filing--.

Column 17, line 33 delete "filling" and insert --filing--.

Column 18, line 8, delete "and" and insert --the--.

Column 20, line 13 delete "19" and insert --26--.

Column 20, line 46 delete "cloe" and insert --close--.

Signed and Sealed this

Seventh Day of November, 1989

*Attest:*

JEFFREY M. SAMUELS

*Attesting Officer* *Acting Commissioner of Patents and Trademarks*